US005127326A

United States Patent [19]

Nelson et al.

[11] Patent Number: 5,127,326

[45] Date of Patent: Jul. 7, 1992

[54] INK KEY CONTROL APPARATUS

[75] Inventors: Craig W. Nelson, Elk Grove; Jeffrey N. Thon, Carmichael, both of Calif.

[73] Assignee: Cra-Tek Industrial Controls, Inc., Sacramento, Calif.

[21] Appl. No.: 692,351

[22] Filed: Apr. 26, 1991

[51] Int. Cl.[5] ..... B41F 31/04; B41U 27/06

[52] U.S. Cl. ..... 101/365

[58] Field of Search ..... 101/365, 350, 363, 157, 101/169; 118/261

[56] References Cited

U.S. PATENT DOCUMENTS

| | | | |
|---|---|---|---|
| 3,895,575 | 7/1975 | Cappel et al. | 101/365 |
| 4,051,782 | 10/1977 | Fernandez | 101/365 |
| 4,159,651 | 7/1979 | MacPhee | 101/365 X |
| 4,402,264 | 9/1983 | Weisgerber | 101/365 |
| 4,596,187 | 6/1986 | Ruger | 101/365 |
| 4,669,382 | 6/1987 | Jentzsch et al. . | |
| 4,709,635 | 12/1987 | Kubert et al. . | |
| 4,711,176 | 12/1987 | Michel . | |
| 4,729,312 | 3/1988 | Rodi et al. . | |
| 4,803,923 | 2/1989 | Kenichi . | |
| 4,829,898 | 5/1989 | Wieland . | |
| 4,864,930 | 9/1989 | Runyan et al. . | |

FOREIGN PATENT DOCUMENTS 2132139 7/1984 United Kingdom .

*Primary Examiner*—J. Reed Fisher

*Attorney, Agent, or Firm*—John P. O'Banion

[57] ABSTRACT

A computer operated device for controlling an ink key (58) used to adjust the position of a fountain blade used in an ink fountain of a printing apparatus. A linear actuator (10) imparts reciprocating axial motion to a shaft (14) which in turn actuates a lever arm (34). The lever arm (34) operates an eccentrically pivoting cam (36) which transforms the axial motion from the linear actuator (10) into eccentric rotational motion. A second cam (48) reconverts the eccentric rotational motion of the first cam (36) into reciprocating axial motion and imparts that motion to the ink key (58) with a substantial reduction in distance of travel relative to that of the shaft (14) of the linear actuator (10), thereby permitting precise incremental adjustment of the position of the ink key (58).

20 Claims, 3 Drawing Sheets

INK KEY CONTROL APPARATUS

BACKGROUND OF THE INVENTION

1. Field of the Invention

This invention pertains generally to ink fountains utilized in offset printing apparatus, and more specifically to a control apparatus for adjusting the position of ink keys utilized in ink fountains.

2. Description of the Background Art

In the area of offset printing apparatus, ink fountains are generally used. Contained within the typical ink fountain is an inking roller (commonly called a fountain roller) and an ink metering blade (commonly called a fountain blade) which is positioned adjacent to the fountain roller. The position of the fountain blade in relation to the fountain roller is such that a gap is formed. The spacing of the gap determines the amount of ink that is applied to the fountain roller, and which in turn is transferred via other rollers to a print medium such as paper. Because it is quite common for the amount of ink transferred to vary across the print medium, it is often necessary to adjust the spacing of the gap across the length of the fountain roller. This adjustment is generally performed by operating manually or electrically controlled adjusting keys (commonly called ink keys) which are located at fixed locations along the length of the ink fountain. By moving the position of the fountain blade with respect to the position of the fountain roller, each ink key controls the spacing of the gap with respect to a particular segment, or zone, of the print medium.

Heretofore, ink keys have been of a screw-type which have required adjustment by application of rotational force or of a pusher-type which require application of a reciprocating force. Examples of devices which have been previously developed for application of rotational force are disclosed in U.S. Pat. No. 4,864,930 issued to Runyan et al. on Sep. 12, 1989; U.S. Pat. No. 4,669,382 issued to Jentzsch et al. on Jun. 2, 1987; U.S. Pat. No. 4,709,635 issued to Kubert et al. on Dec. 1, 1987; and U.S. Pat. No. 4,803,923 issued to Kenichi on Feb. 14, 1989. Examples of devices which have been previously developed for application of reciprocating force are disclosed in U.S. Pat. No. 4,711,176 issued to Michel on Dec. 8, 1987; and U.S. Pat. No. 4,829,898 issued to Wieland on May 16, 1989. Examples of devices which have been previously developed using eccentric discs which are used to adjust the position of the blade are disclosed in British Pat. No. 2,132,139 issued to Albert on Jul. 4, 1984; and U.S. Pat. No. 4,729,312 issued to Rodi et al. on Mar. 8, 1988. While the foregoing patents disclose devices which are capable of controlling the spacing of the gap between the fountain roller and the fountain blade, they do not provide for the fine incremental adjustments and repeatability of settings provided by the present invention.

The foregoing patents reflect the state of the art of which the applicants are aware and are tendered with the view toward discharging the applicants' acknowledged duty of candor in disclosing information which may be pertinent in the examination of this application. It is respectfully stipulated, however, that none of these patents teach or render obvious, singly or when considered in combination, the applicants' claimed invention.

SUMMARY OF THE INVENTION

The present invention provides for "push-pull" operation of ink keys utilized in connection with the ink fountain of an offset printing apparatus, as opposed to rotational operation of ink keys more commonly employed. The ink key is removed from the ink fountain and replaced with the mechanism of the present invention.

By way of example and not of limitation, the present invention generally comprises a linear actuator, a lever arm, an intermediate cam, a driver cam, and an ink key, all of which are contained within a housing. One end of the lever arm is connected to the shaft of the linear actuator. Rigidly attached to the other end of the lever arm is an intermediate cam, cylindrical in shape, in which an off-center hole is located. A pin extending through the hole in the intermediate cam and into the housing pivotally connects the intermediate cam to the housing. The driver cam contains a hole sufficiently large to permit it to be placed over the intermediate cam with a circular bearing located between their circumferences. Located at one edge of the driver cam is a threaded receptacle for acceptance of an ink key. When the ink key is installed, the longitudinal axis of the ink key will be substantially parallel to the longitudinal axis of the shaft of the linear actuator. When the linear actuator is operated, the ink key follows the direction of the shaft of the linear actuator with a push-pull, or reciprocating, movement. Utilization of a lever arm, intermediate cam, and driver cam in this manner provides for an approximately 12.5 to 1 reduction in distance of travel between the ink key and the shaft of the linear actuator; that is, when the shaft of the linear actuator moves 0.001 inches, the ink key moves in the same direction a distance of approximately 0.00008 inches. By using a linear actuator capable of movement in steps of 0.001 inches, extremely fine adjustment of the spacing of the gap between the fountain roller and the fountain blade is made possible. Additionally, the apparatus can produce pressure on the ink key in an amount equal to approximately 12.5 times that produced by the linear actuator.

An object of the invention is to provide for reciprocating movement of ink keys.

Another object of the invention is to provide for adjustment of the spacing of the gap between the fountain roller and fountain blade in increments of approximately 0.00008 inches.

Another object of the invention is to provide for linear adjustment of ink keys.

Another object of the invention is to prevent the fountain blade from damaging the fountain roller.

Another object of the invention is to permit the ink key to break through dried ink and continue operation.

Another object of the invention is to provide for remote control of ink keys.

Another object of the invention is to provide an ink key control apparatus which can be installed without alteration of the existing printing apparatus.

Another object of the invention is to eliminate the use of gears for positional control of a fountain blade.

Another object of the invention is to eliminate imprecise control resulting from gear backlash.

Another object of the invention to provide for efficient transfer of linear to linear motion.

Another object of the invention is to permit high speed control of an ink key.

Another object of the invention is to provide an ink key servo mechanism with minimum parts and high reliability.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The present invention will be more fully understood by reference to the following drawings which are for illustrative purposes only.

DESCRIPTION OF THE PREFERRED EMBODIMENTS

Figure 1:
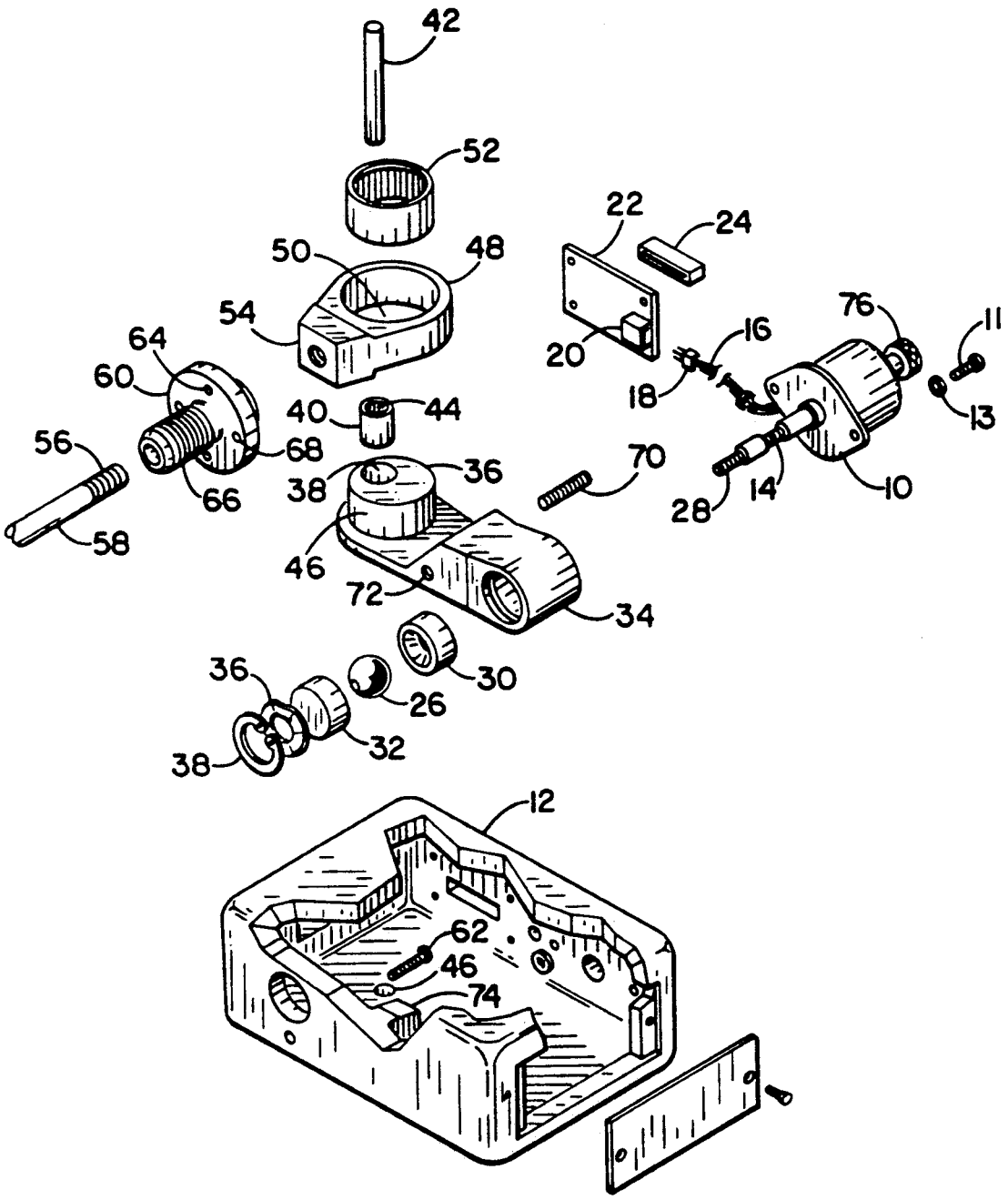
FIG. 1 is an exploded view of the preferred embodiment of the present invention.
Figure 2:
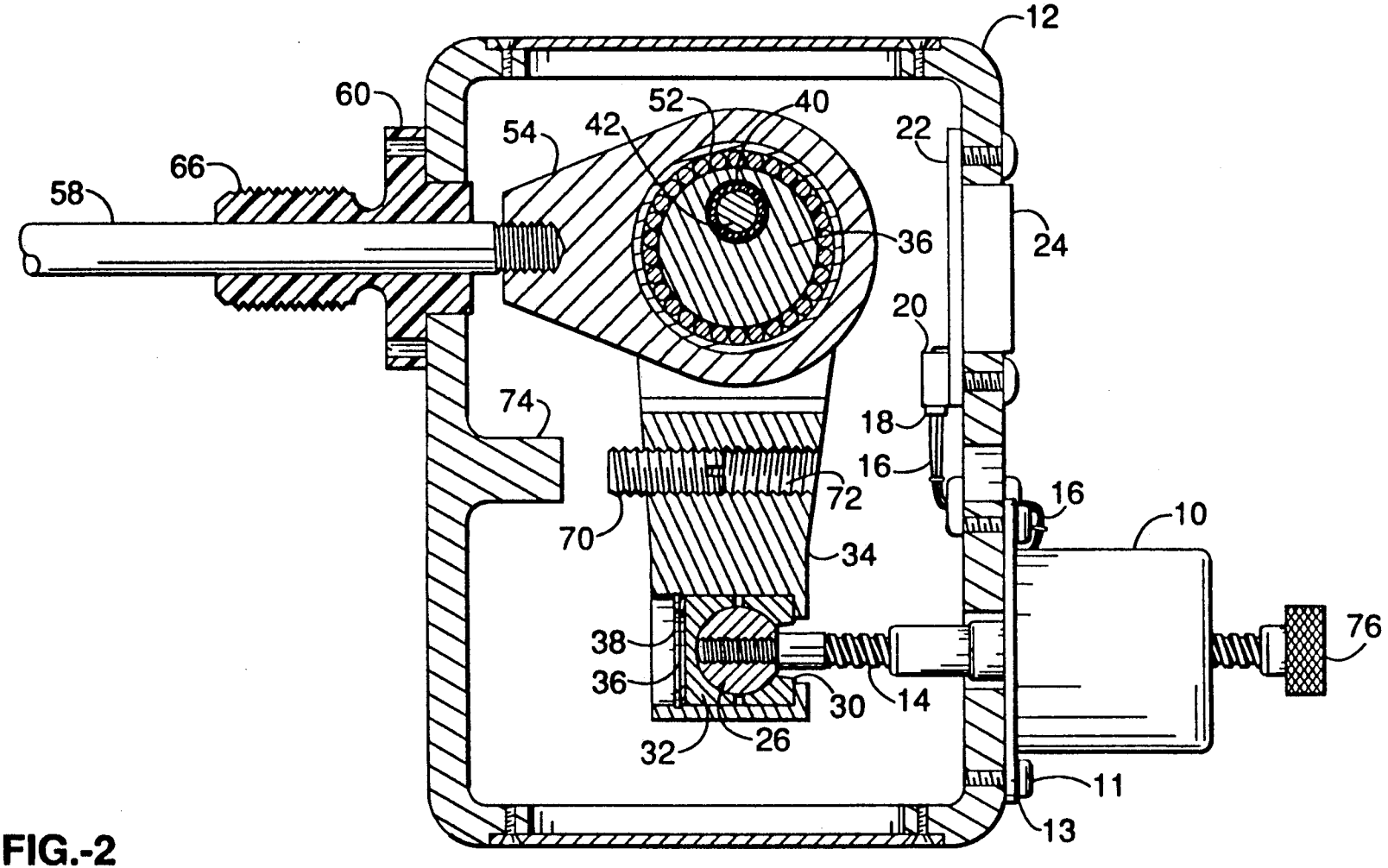
FIG. 2 is a cross-sectional view of the apparatus shown in FIG. 1.

Referring more specifically to the drawings, for illustrative purposes the present invention is embodied in the apparatus generally shown in FIG. 1 and FIG. 2. It will be appreciated that the apparatus may vary as to configuration and as to details of the parts without departing from the basic concepts as disclosed herein.

In the preferred embodiment, the actuating means comprises linear actuator 10. Linear actuator 10 is securely mounted to housing 12 which encloses the components of the apparatus using a plurality of screws 11 and washers 13. Linear actuator 10 includes an internal threaded rotor to which shaft 14 is attached.

Linear actuator 10 is typically electrically controlled to operate in linear increments of 0.001 inches, thereby producing reciprocating axial motion of shaft 14. A second mode of operation will produce movement of shaft 14 in increments of 0.0005 inches. The linear output force of linear actuator 10 applied to shaft 14 is inversely proportional to the linear step rate; that is, a faster step rate yields a lower linear force.

To minimize cost, instead of including control circuitry within housing 12, connection wires 16 are brought out of linear actuator 10 and terminated in connector 18. Connector 18 then mates with receptacle 20 on connection board 22, which is wired to connector 24 for external control of the apparatus.

Shaft 14 is coupled to ball joint 26 using threads 28 which mate with threads internal to ball joint 26. Ball joint 26 is straddled by bushing 30 and cup 32 which together are pressed into lever arm 34 at one end and held in place by spring washer 36 and retention clip 38 to form a split radial bushing. Nylon is the preferred choice of materials for bushing 30 and cup 32. This permits shaft 14 to move lever arm 34 without placing lateral stress on shaft 14 and consequently linear actuator 10, which would otherwise occur if shaft 14 were rigidly attached to lever arm 34. Additionally, there is enough holding force applied to ball joint 26 to prevent shaft 14 from spinning when linear actuator 10 is operated.

Attached to the opposite end of lever arm 34 is cam 36 which forms a lobe securely attached to, or machined from, lever arm 34. Cam 36 is cylindrical in shape and has a first face and a second face, one of the two faces mating with lever arm 34. Extending through cam 36 and between the two faces therein is opening 38, which is eccentrically located within cam 36. The off-center placement of opening 38 is critical to the operation of the apparatus. Bearing 40, which comprises a needle bearing, is pressed into opening 38. Use of a needle bearing minimizes backlash and improves accuracy. Pin 42 extends through opening 44 in the center of bearing 40 and into opening 46 in housing 12, thereby pivotally coupling lever arm 34 to housing 12.

Figure 3:
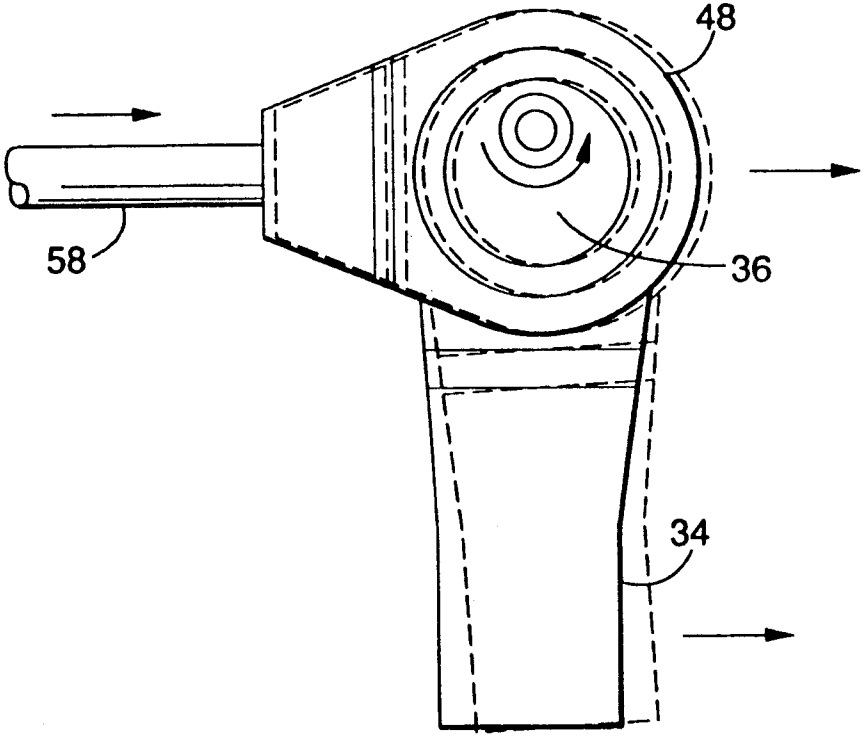
FIG. 3 is an orthogonal schematic view of the lever arm and cam components of the present invention showing the transformation of rotational and axial motion.

Thus far the portion of the apparatus which causes movement of lever arm 34 and cam 36 has been described. Referring also to FIG. 3, when shaft 14 is extended or retracted by linear actuator 10, the axial motion of shaft 14 is transferred to lever arm 34. Cam 36 attached to lever arm 34 pivots about pin 42, thus transforming the axial motion of shaft 14 into rotational motion of cam 36. Because opening 38 in cam 36 is located off-center, the rotational motion of cam 36 and its surface 46 is eccentric.

Cam head 48 serves as a driver cam for the apparatus. Cam head 48 includes an opening 50 into which bearing 52 is inserted. Bearing 52 is a needle bearing of the same type as bearing 40. The opening in bearing 52 then fits over cam 36. Cam head 48 is oblong in shape and includes driver lobe 54. Driver lobe 54 has internal threads which mate with threads 56 on ink key 58. Cam head 48 is operated by cam 36 and transforms the eccentric rotational motion of cam 36 into axial motion imparted to ink key 58. Referring also to FIG. 3, when cam 36 rotates its eccentric motion causes cam head 48 to move along an axis substantially parallel to the longitudinal axis through shaft 14. This results in axial motion being imparted to ink key 58. The relationship of the sizes between cam 36 and cam head 48 results in a transformation which is linear with an approximate 12.5 to 1 reduction in distance of travel between ink key 58 and shaft 14; that is, when linear actuator 10 causes shaft 14 to move 0.5 inches, ink key 58 moves in the same direction a distance of approximately 0.04 inches.

FIG. 3 schematically shows the transformation of motion as described above. To retract ink key 58, linear actuator 10 is actuated to impart axial motion to shaft 14. When shaft 14 is retracted by linear actuator 10, lever 34 moves toward linear actuator 10. As a result, cam 36 rotates counterclockwise around pin 42. The eccentric rotation of cam 36 is transferred to cam head 48 where is it transformed into axial motion imparted to ink key 58. Ink key 58 then retracts, following the same direction of travel as shaft 14. This transformation of the rotational motion of cam 36 into substantially axial motion of cam head 48 occurs because cam 36 rotates only slightly. Otherwise, cam head 48 would rotate with cam 36. Extension of ink key 58 follows the same pattern of motion, except that linear actuator 10 is actuated to extend shaft 14 causing cam 36 to rotate clockwise.

Ink key 58 slides within bushing 60 which acts as a guide. Bushing 60 is securely mounted to housing 12 using a plurality of screws 62 extending through threaded openings 64. Bushing 60 has an external threads 66 for attaching the apparatus to an ink fountain and smooth bore openings 68 for tightening with a spanner wrench. It should be noted that the length of ink key 58 and the size of bushing 60 are configured to mate with each particular ink fountain and are the only components unique to each printing press. The remainder of the apparatus contains completely interchangeable components.

In order to prevent damage to the fountain blades and fountain roller in the ink fountain from excessive travel of ink key 58, the apparatus contains an adjustable stop 70. Stop 70 includes threads which mate with threaded opening 72 in lever arm 34. With proper adjustment, stop 70 extends through threaded opening 72 and engages anvil 74 in housing 12, thus limiting the amount of travel of lever arm 34. On initial installation and setup, the maximum travel of ink key 58 is set by using a feeler gauge to set a gap between the fountain roller and the fountain blade. Manual adjust knob 76 is then rotated until the proper gap is set. Stop 70 is then rotated until its bottoms out against anvil 74. Manual adjust knob 76 is also available for adjustment of the position of ink key 58 in the event of failure of linear actuator 10.

In operation, the present invention is used to vary the amount of ink on a fountain roller used in an offset printing process. The amount of ink required is determined by the pattern on the printing plates. Ink is deposited on the rollers from an ink reservoir using the flexible edge of a fountain blade. The distance the blade is away from the fountain roller determines the amount of ink deposited. The present invention is used to vary that distance, thereby varying the amount of ink used. Typically, the total gap between the fountain roller and the fountain blade is between 0.001 inches (no ink) and 0.03 inches (full ink).

Ink key 58 is retracted or extended to move the fountain blade and thereby vary the gap between the fountain blade and the fountain roller. Ink key 58 does not attach to the fountain blade to pull it back; rather, the fountain blade springs back toward its rest position (which is at a distance greater than the full ink position) when ink key 58 is retracted. Linear actuator 10 can be actuated in steps of 0.001 inches at a step rate of one hundred steps per second, thereby producing a force of approximately eighty ounces. The ratio of transformation from lever arm 34 to cam 36 to cam head 48 is 12.5 to 1, thereby imparting a force of approximately sixty-two and one-half pounds to ink key 58. This level of force, which is in turn imparted to the fountain blade, is sufficient to overcome binding of ink key 58 which may result from dried ink. Additionally, the transformation ratio is such that each 0.001 inch step of shaft 14 results in ink key 58 moving only 0.00008 inches. For example, in order to move ink key 58 and the fountain blade a distance of 0.029 inches, which is essentially the full range of adjustment of the gap between the fountain roller and the fountain blade, the system operator will actuate linear actuator 10 to produce 362.5 steps. This results in very precise movement of the fountain blade over a wide range of incremental settings.

In normal operation, linear actuator 10 requires a step pulse width of one millisecond to achieve factory specifications. It should be noted, however, that linear actuator 10 is capable of enhanced performance in that it can also operate in half-steps of 0.0005 inches. It should also be noted that linear actuator 10 has a holding force sufficient to maintain the position of ink key 58 and the fountain blade without continued actuation. This serves as a power saving feature. Power is applied only during adjustment of the position of ink key 58. In addition, an ink fountain requires multiple ink keys for adjustment of the fountain blade, thereby requiring multiple units of the present invention. The number of units required is determined by the length of the fountain roller and the spacing between ink keys. However, ink keys need only be adjusted one at a time. Therefore, by operating only one unit of the present invention at a time, total power consumption can be reduced. Additionally, multiplexing over a control cable to operate multiple linear actuators can be used to address and operate individual units.

External control of the apparatus is performed by a microprocessor based motion controller which includes a high current driver for linear actuator 10. The microprocessor records and processes the position of shaft 14 and moves shaft 14 on demand. Position feedback is not used, since the microprocessor provides positive control of linear actuator 14. The microprocessor also communicates with a host computer system where the operator of the printing apparatus will determine the desired position of each ink key. Communication with the host is facilitated with high speed serial data transfer.

The invention described herein eliminates the use of gears and, therefore, prevents imprecise control resulting from gear backlash. By using linear to linear motion, efficient transfer of motion can be thus be effected. Accordingly, it will be seen that this invention provides for complete and accurate positional control of an ink key and fountain blade in a printing apparatus. Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. An ink key control apparatus for an ink fountain having at least one ink key, comprising:

(a) a lever arm, said lever arm having a first end and a second end;

(b) actuating means for imparting reciprocating motion to said first end of said lever arm, said actuating means including a shaft coupled to said first end of said lever arm, said actuating means imparting reciprocating motion to said first end of said lever arm along the longitudinal axis of said shaft;

(c) first cam means for transforming said reciprocating motion imparted to said first end of said lever arm into eccentric rotational motion, said first cam means attached to said second end of said lever arm; and (d) second cam means for transforming said eccentric rotational motion into reciprocating motion along an axis substantially parallel to the longitudinal axis of said shaft, said second cam means coupled to said first cam means, said second cam means adapted for coupling to said ink key.

2. The apparatus as recited in claim 1, wherein said actuating means comprises a linear actuator, said linear actuator imparting movement to said shaft in a plurality of discrete steps.

3. The apparatus as recited in claim 1, wherein said first cam means comprises a cylindrical-shaped lobe, said lobe having a first face and a second face, said lobe having an opening extending between said first face and said second face, said opening eccentrically located within said lobe.

4. The apparatus as recited in claim 1, wherein said second cam means comprises an oblong-shaped cam head, said cam head having a first face and a second face, said cam head having an opening extending between said first face and said second face, said opening for receiving said first cam means.

5. The apparatus as recited in claim 1, further comprising stop means for limiting the travel of said ink key.

6. The apparatus as recited in claim 5, wherein said stop means is adjustably coupled to said lever arm.

7. The apparatus as recited in claim 6, further comprising bearings, said bearings disposed between the exterior surface of said first cam means and the interior surface defining said opening in said second cam means.

8. The apparatus as recited in claim 7, further comprising a housing, said lever arm pivotally coupled to said housing, said actuating means securely mounted to said housing.

9. A servo device for controlling the position of a fountain blade in an ink fountain of a printing apparatus having at least one ink key, comprising:

(a) a lever arm, said lever arm having a first end and a second end;

(b) a linear actuator, said linear actuator including a shaft, said shaft coupled to said first end of said lever arm, said linear actuator imparting axial reciprocating motion to said first end of said lever arm along the longitudinal axis of said shaft;

(c) first cam means for transforming said axial reciprocating motion imparted to said shaft into eccentric rotational motion, said first cam means attached to said second end of said lever arm; and (d) second cam means for transforming said eccentric rotational motion into axial reciprocating motion along an axis substantially parallel to the longitudinal axis of said shaft, said second cam means coupled to said first cam means, said second cam means adapted for coupling to said ink key.

10. The apparatus as recited in claim 9, wherein said first cam means comprises a cylindrical-shaped lobe, said lobe having a first face and a second face, said lobe having an opening extending between said first face and said second face, said opening eccentrically located within said lobe.

11. The apparatus as recited in claim 9, wherein said second cam means comprises an oblong-shaped cam head, said cam head having a first face and a second face, said cam head having an opening extending between said first face and said second face, said opening for receiving said first cam means.

12. The apparatus as recited in claim 9, further comprising stop means for limiting the axial travel of said ink key, said stop means adjustably coupled to said lever arm.

13. The apparatus as recited in claim 12, further comprising bearings, said bearings disposed between the exterior surface of said first cam means and the interior surface defining said opening in said second cam means.

14. The apparatus as recited in claim 13, further comprising a housing, said lever arm pivotally coupled to said housing, said actuating means securely mounted to said housing.

15. An ink key servo unit for an ink fountain having at least one ink key, comprising:

(a) a linear actuator, said linear actuator including a shaft, said linear actuator imparting axial reciprocating motion to said shaft along its longitudinal axis;

(b) a housing to which said linear actuator is securely mounted;

(c) a lever arm, said lever arm having a first end and a second end, said first end coupled to said shaft;

(d) a cylindrical-shaped lobe, said lobe having a first face and a second face, said lobe having an opening extending between said first face and said second face, said opening eccentrically located within said lobe, said lobe attached to said second end of said lever arm; and (e) an oblong-shaped cam head, said cam head having a first face and a second face, said cam head having an opening extending between said first face and said second face, said opening centrally located within said cam head, said opening for receiving said lobe, said cam head adapted for coupling to said ink key, whereby the longitudinal axis through said ink key will be substantially parallel to the longitudinal axis of said shaft.

16. The apparatus as recited in claim 15, further comprising stop means for limiting the axial travel of said ink key, said stop means adjustably coupled to said lever arm.

17. The apparatus as recited in claim 16, further comprising bearings disposed between the exterior surface of said lobe and the interior surface of said cam head surrounding said opening in said cam head.

18. The apparatus as recited in claim 17, wherein said lever arm is pivotally coupled to said housing.

19. The apparatus as recited in claim 18, wherein said cam head includes a threaded opening, said threaded opening for receiving threads located on one end of said ink key.

20. The apparatus as recited in claim 19, further comprising a guide tube, said guide tube securely mounted to said housing, said guide tube for insertion of said ink key therein.

* * * * *